US006533615B2

(12) United States Patent
Koide et al.

(10) Patent No.: US 6,533,615 B2
(45) Date of Patent: Mar. 18, 2003

(54) SHIELDING TERMINAL AND A CONNECTOR PROVIDED THEREWITH

(75) Inventors: Takashi Koide, Yokkaichi (JP); Masahiko Aoyama, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/039,966

(22) Filed: Jan. 2, 2002

(65) Prior Publication Data

US 2002/0142658 A1 Oct. 3, 2002

(30) Foreign Application Priority Data

Apr. 1, 2001 (JP) ..... 2001-000240

(51) Int. Cl.[7] ..... H01R 9/03
(52) U.S. Cl. ..... 439/610; 439/545
(58) Field of Search ..... 439/610, 607, 439/608, 609, 353, 354, 595

(56) References Cited

U.S. PATENT DOCUMENTS 6,171,150 B1 1/2001 Saito et al. ..... 439/610

FOREIGN PATENT DOCUMENTS

JP 8-96895 4/1996
JP 2000021486 A * 1/2000 ..... H01R/13/42

* cited by examiner

*Primary Examiner*—P. Austin Bradley
*Assistant Examiner*—Ross Gushi
(74) *Attorney, Agent, or Firm*—Anthony J. Casella; Gerald E. Hespos

(57) ABSTRACT

A shielding terminal (15) is accommodated in a cavity (21) of a housing (20) in a connector (10) and is doubly locked by a lock (25) of the housing (20) and by a ground terminal (50). A recess (16D) is formed in a shielding shell (16) of the shielding terminal (15) during the formation of a locking claw (16B) for locking a dielectric element. The recess (16D) is narrower than the lock (25). Hence, the lock (25) neither enters nor gets caught by the recess (16D) during insertion of the shielding terminal (15) into the cavity (21). Therefore, an insertion resistance of the shielding terminal (15) can be reduced.

6 Claims, 21 Drawing Sheets

SHIELDING TERMINAL AND A CONNECTOR PROVIDED THEREWITH

BACKGROUND OF THE INVENTION

1. Field of the Invention

The invention relates to a shielding terminal that can be accommodated in a connector housing and to a connector with such shielded terminal.

2. Description of the Related Art

A known shielding terminal is disclosed in U.S. Pat. No. 6,171,150 and is identified by the numeral 1 in FIG. 22 herein. The shielding terminal 1 has a shell 2. An inner terminal 3 is connected with a core of a shielded wire W and is accommodated in the shielding shell 2. A dielectric element 4 is provided between the inner terminal 3 and the shielding shell 2. The shielding shell 2 of the shielding terminal 1 is formed with a locking claw 5 that is bent inwardly from a location forward of a rear end 6 of a ceiling wall to lock the dielectric element 4 inside the shielding shell 2. The formation of the locking claw 6 creates a recess 7 in the ceiling wall.

The shielding terminal 1 is used with a housing that has a cavity and a lock that projects into the cavity. The lock moves in sliding contact with the ceiling wall of the shielding shell 2 from the front end to a rear end 6 of the ceiling wall. The lock is deflected during the sliding contact with the ceiling wall of the shielding shell 2. However the lock is restored resiliently to its original shape after passing the rear end 6 of the ceiling wall and engages the rear end 6 of the ceiling wall to lock the shielding terminal 1 in the cavity.

The lock of the housing is likely to enter and get caught by the recess 7 during insertion of the shielding terminal 1 into the cavity. Thus, there is a possibility of increasing an insertion resistance of the shielding terminal 1.

The present invention was developed in view of the above problem, and an object thereof is to reduce an insertion resistance when a shielding terminal is inserted into a housing.

SUMMARY OF THE INVENTION

The invention is directed to a shielding terminal with an inner terminal configured for connection with a core of a shielded wire. A dielectric element is mounted over at least portions of the inner terminal. The shielding terminal also has a shielding shell with a main body that accommodates at least portions of the inner terminal and the dielectric element. The main body has a side surface formed with an engaging portion.

The shielding terminal is insertable into the cavity of a connector housing. The housing is formed with a lock that is deformed resiliently and slid along the side surface of the main body during an intermediate stage of insertion of the shielding terminal into the cavity. The lock then engages the engaging portion of the main body after the shielding terminal has been inserted to a proper insertion depth into the cavity.

A recess is formed in one side surface of the main body at a location before the engaging portion. Thus, the lock passes the recess during insertion of the shielding terminal into the cavity. However, the leading end of the lock is wider than the recess. Thus, the lock neither enters nor gets caught by the recess, and insertion resistance of the shielding terminal is low.

At least one locking claw preferably is formed in one side surface of the main body by cutting the side surface and bending the cut portion inwardly. The locking claw is configured for locking the dielectric element in the shielding shell. The recess may be formed by bending the locking claw.

The locking claw preferably has a base end that is substantially continuous with the main body and a distal end cantilevered from the main body. The distal end of the locking claw preferably is wider than the base end, and the distal end of the recess preferably is at least as wide as the distal end of the locking claw.

The invention also is directed to a shielded connector for connection with a shielded wire. The connector comprises a housing with at least one cavity, and at least one shielding terminal, as described above, is insertable into the cavity. The housing is formed with at least one resiliently deformable lock that interacts with the terminal fitting to lock the terminal fitting in the cavity. The lock passes the recess in the side surface of the shielding terminal during insertion of the shielding terminal into the cavity. However, the leading end of the lock is wider than the recess. Accordingly, the lock neither enters nor gets caught by the recess, and insertion resistance of the shielding terminal is low.

The lock is deformed resiliently and held in sliding contact with portions of the side surface of the shielding shell adjacent the recess during an intermediate stage of insertion of the shielding terminal into the cavity.

The main body preferably comprises an engaging portion at a position behind the recess. The engaging portion can engage the lock for locking the shielding terminal in the cavity, when the shielding terminal is inserted to proper depth.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
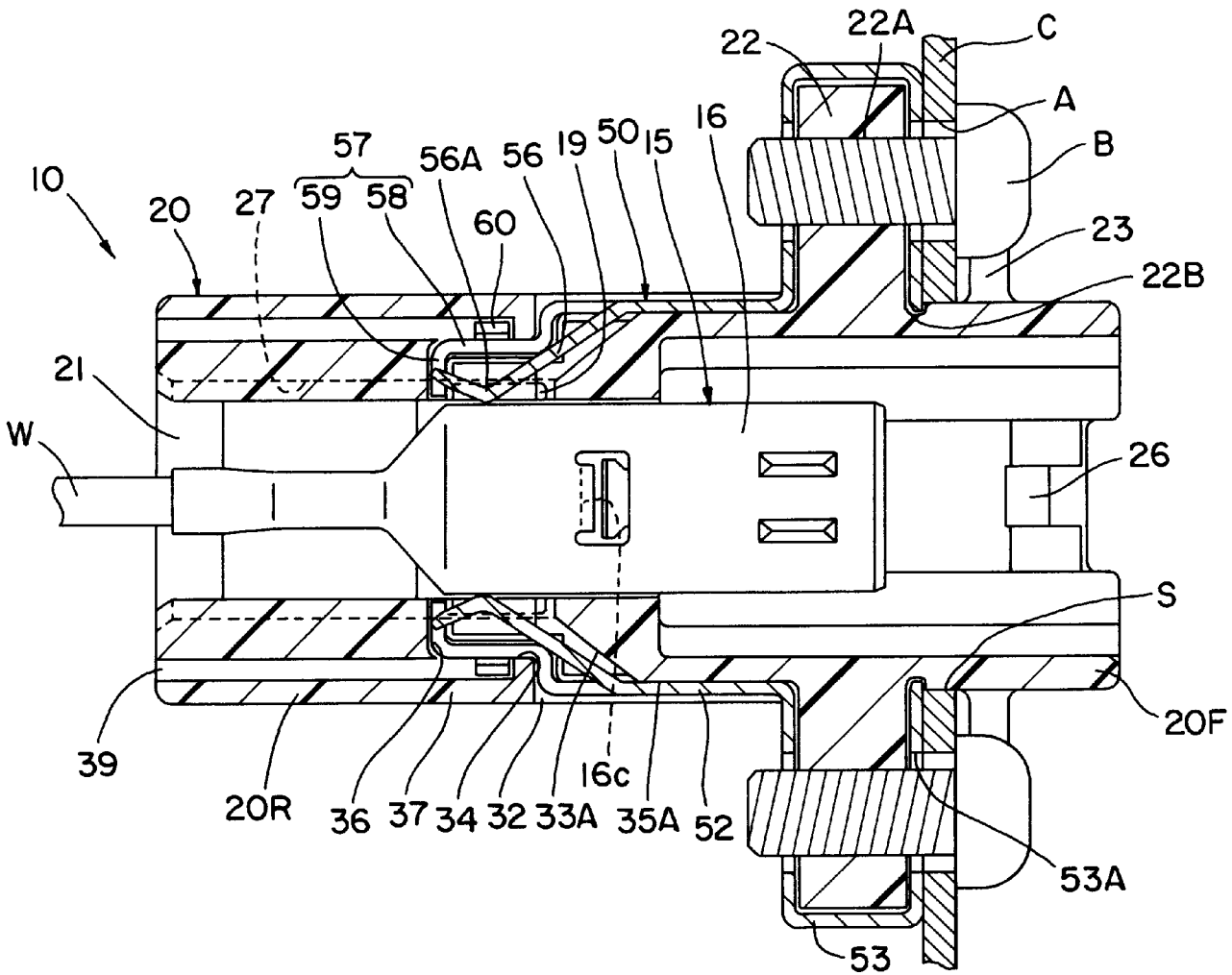
FIG. 1 is a section of a connector according to one embodiment of the invention.
Figure 2:
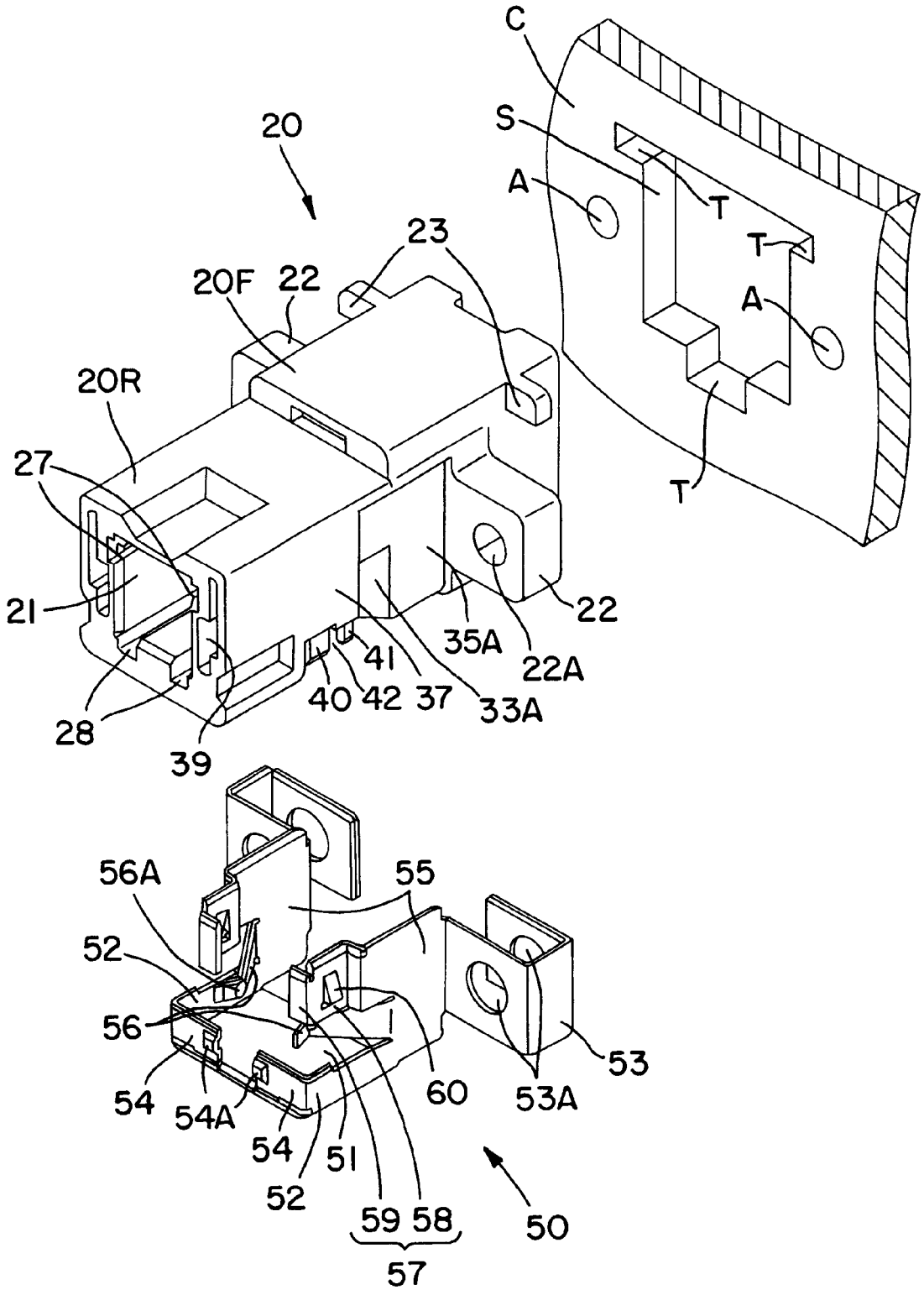
FIG. 2 is an exploded perspective view of the connector.
Figure 4:
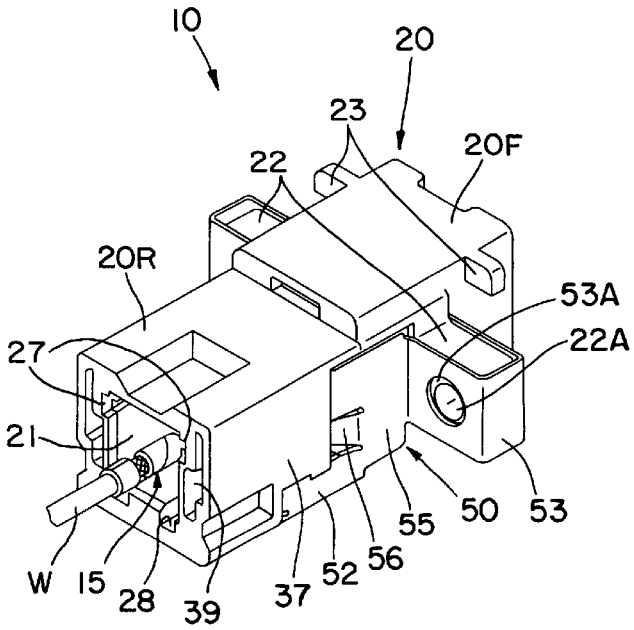
FIG. 4 is a perspective view of the connector with the ground terminal mounted at a full locking position.

A connector in accordance with the subject invention is identified by the numeral 10 in FIGS. 1 and 4. The connector 10 is assembled into a shielded casing C, as shown in FIGS. 1 and 2. The shielded casing C is made from an electrically conductive plate material that is formed substantially into a box shape. More particularly, the shielded casing C has a mounting surface formed with an opening S. Mount holes A are formed in the mounting surface of the shielded casing C at locations spaced slightly from the opening S, and escaping portions T bulge out at the substantially opposite lateral edges and the bottom edge of the opening S.

Figure 17:
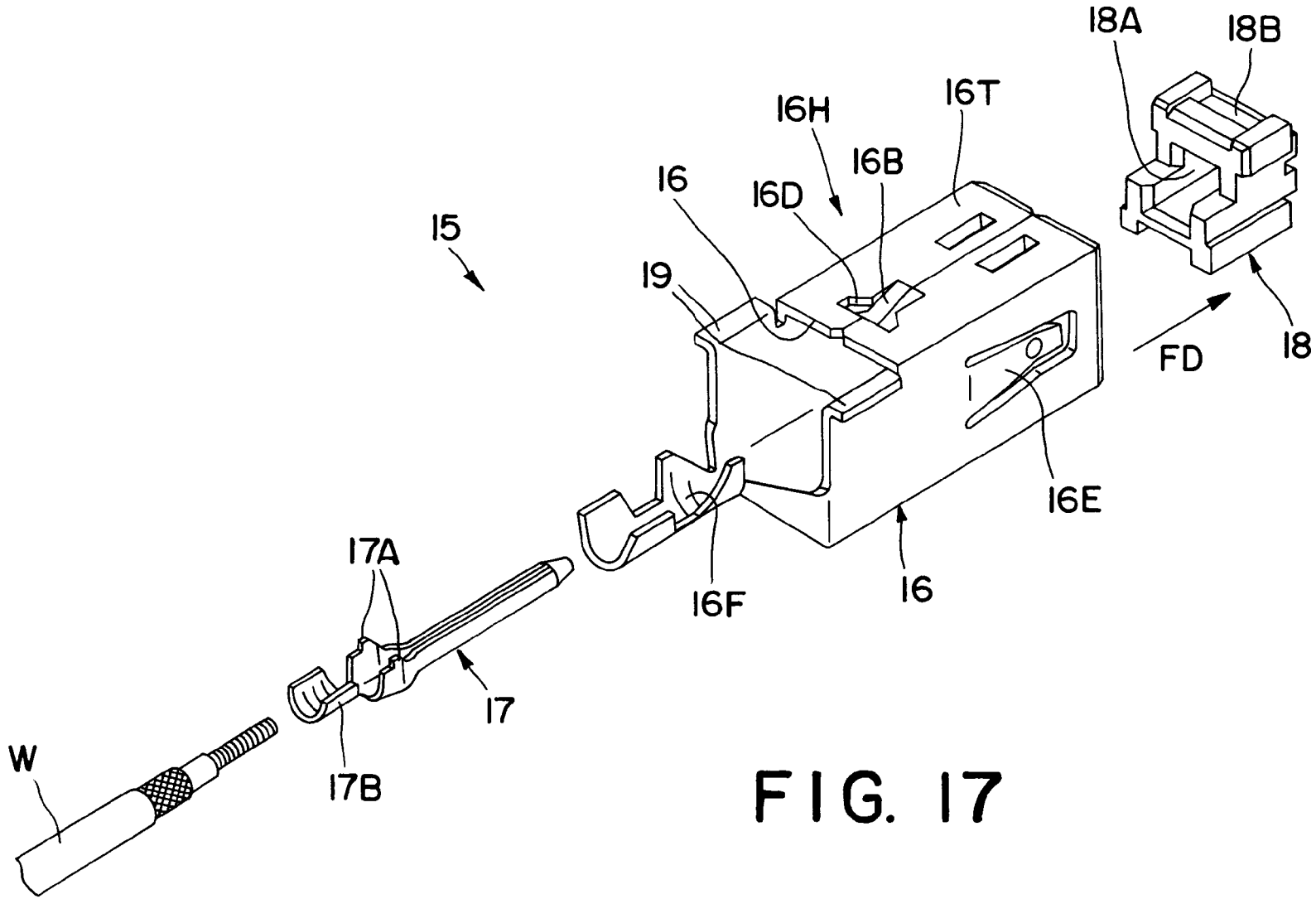
FIG. 17 is an exploded perspective view of the shielding terminal.

The connector 10 includes a shielding terminal 15 that is connectable with the leading end of a shielded wire W. The shielded wire W has a known construction with an inner conductive core. An insulating layer concentrically surrounds the core, a shield layer concentrically surrounds the insulating layer, and a sheath concentrically surrounds the shield layer. The shielding terminal 15 is comprised of a shielding shell 16, an inner terminal 17 disposed at least partly in the shielding shell 16 and a dielectric element 18 between the inner terminal 17 and the shielding shell 16, as shown in FIG. 17.

The inner terminal 17 is an electrically conductive male terminal and a front part of the inner terminal 17 is tab-shaped. Biting projections 17A are provided at an intermediate part of the inner terminal 17 and a crimping portion 17B is provided at the rear of the inner terminal 17. The crimping portion 17B is comprised of crimping pieces that can be crimped, folded or bent into connection with the core of the shielded wire W.

The dielectric element 18 is made of an insulating material, such as resin, and electrically insulates the inner terminal 17 and the shielding shell 16 from each other. An accommodating hole 18A is formed inside the dielectric element 18 for accommodating the inner terminal 17. The biting projections 17A of the inner terminal 17 bite into the dielectric element 18 to fix the inner terminal 17 in the accommodating hole 18A. A locking recess 18B is provided on the outer wall of an upper portion of the dielectric element 18, and a contact portion 18C is provided at the outer wall of a bottom portion thereof (FIG. 19).

Figure 3:
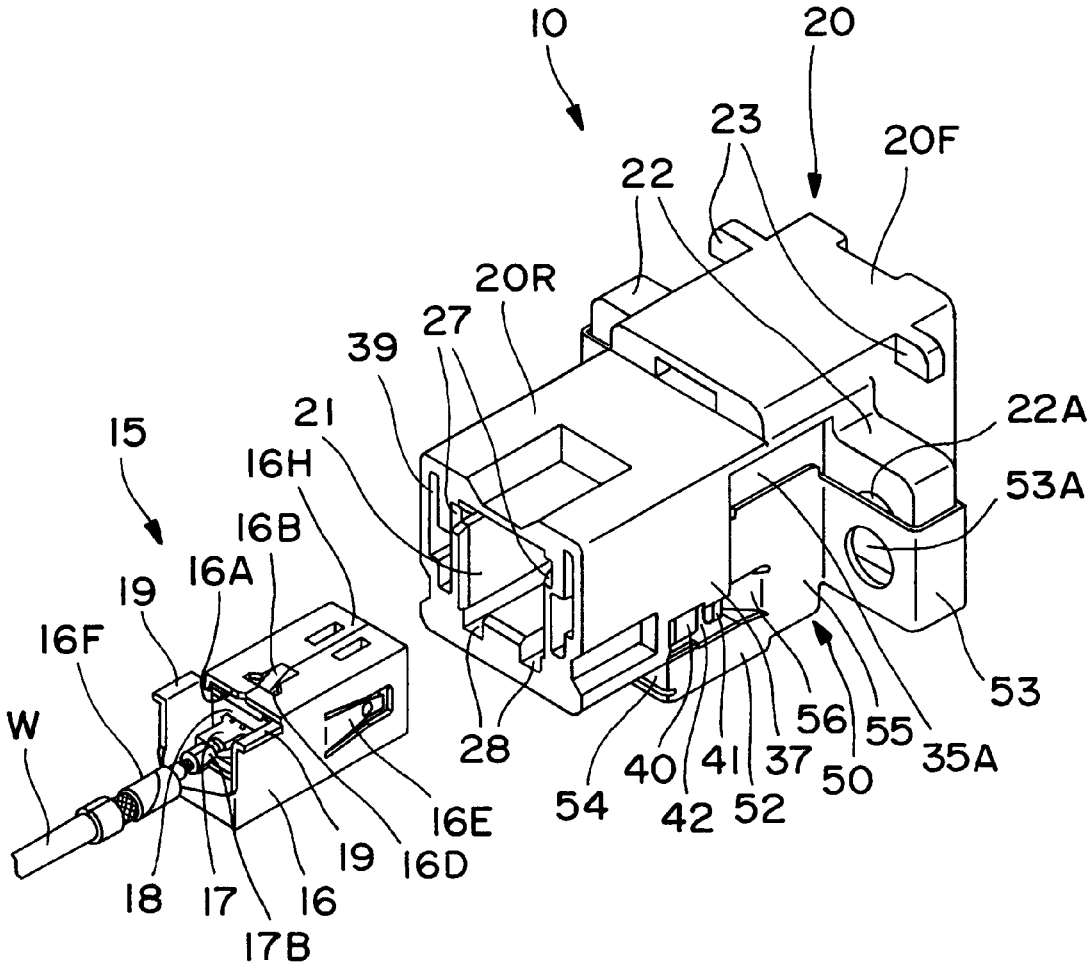
FIG. 3 is a perspective view of the connector with a ground terminal mounted at a partial locking position.

The shielding shell 16 is formed by stamping, cutting, milling, bending and/or embossing an electrically conductive plate and is provided with a main body 16H substantially in the form of a rectangular tube. Contact pieces 16E are formed respectively on the left and right walls of the main body 16H and extend obliquely forward and inward. The contact pieces 16E can be brought resiliently into locking contact with an unillustrated mating shielding terminal. A rear part of the ceiling surface 16T, as seen in a fitting direction FD of the main body 16H, is open as shown in FIGS. 3 and 17, and the front of the open portion defines a locking edge 16A. The opposite side edges of the open portion are bent outwardly to form stabilizers 19. Further, a crimping portion 16F is formed at the rear of the main body 16H, and is configured to be crimped, bent or folded into connection with the shield layer.

Figure 19:
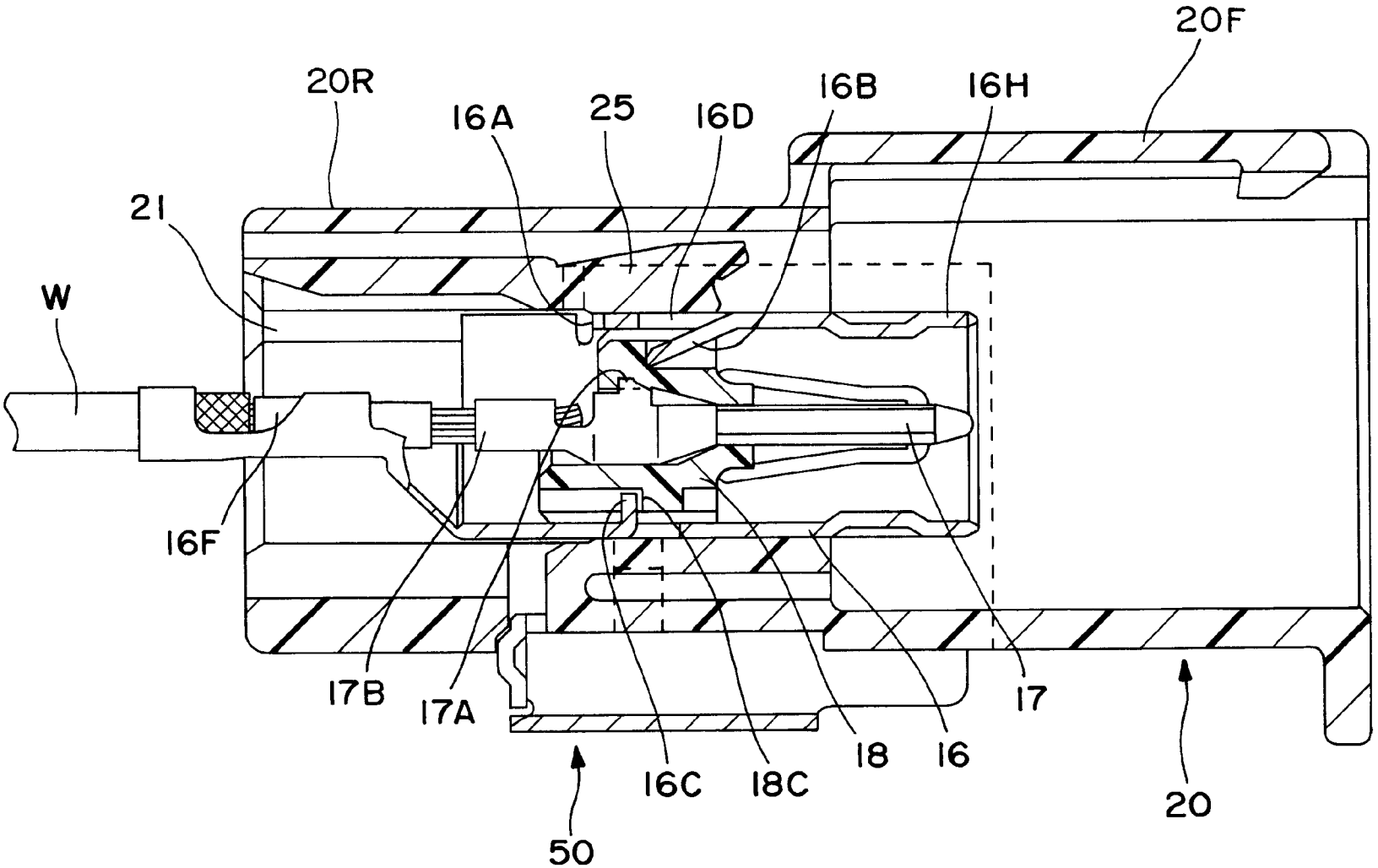
FIG. 19 is a side view in section of the housing during insertion of the shielding terminal.
Figure 20:
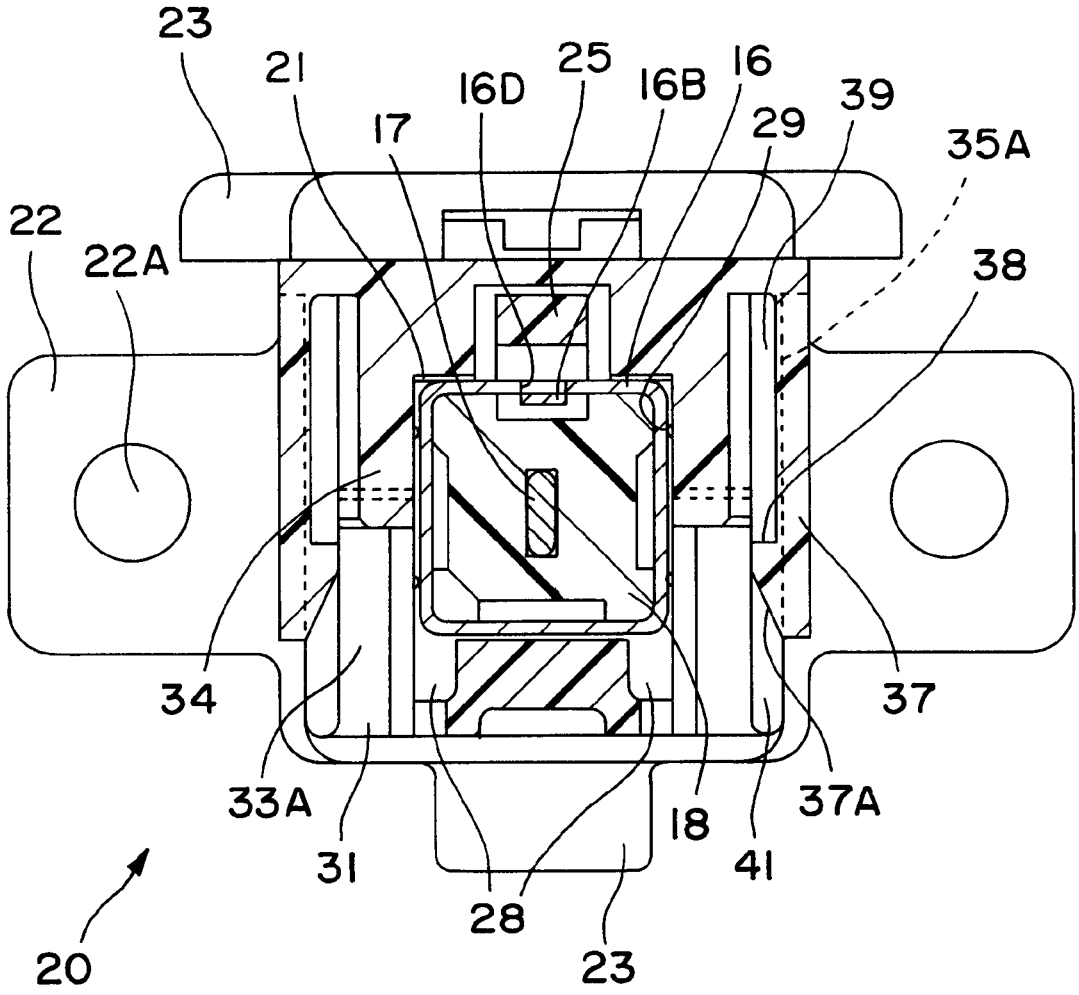
FIG. 20 is a section of the housing during insertion of the shielding terminal.

The shielding shell 16 is formed with a touching piece 16C by making a cut in the bottom wall of the main body 16H and bending the cut portion inwardly at an angle, and preferably at substantially right angles (see FIG. 19). The touching piece 16C controls the depth of insertion of the dielectric element 18 into the main body 16H.

Figure 18:
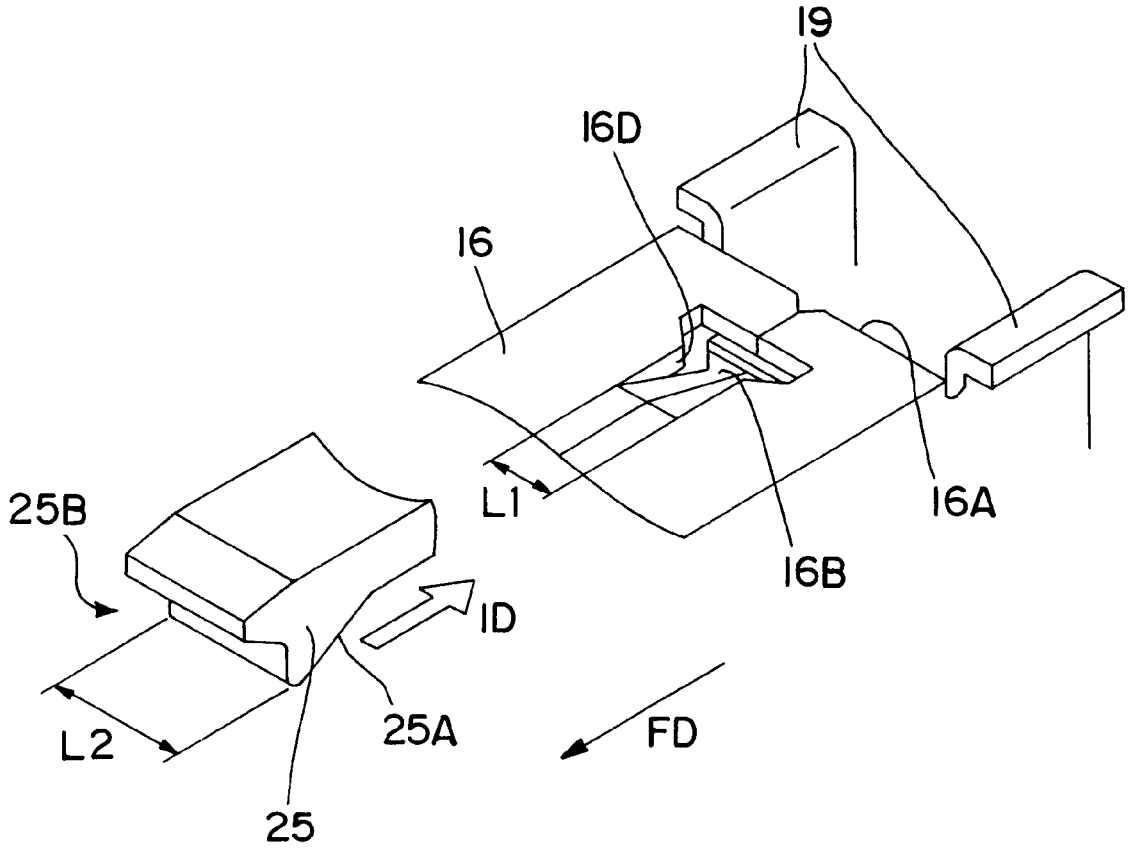
FIG. 18 is an enlarged perspective view showing a recess of the shielding terminal and a locking portion of the housing.

A locking claw 16B is formed in the ceiling wall 16T of the main body 16H of the shielding shell 16 and, as shown in FIG. 18, extends obliquely inward and backward relative to the fitting direction FD. The locking claw 16B is deformed resiliently inward to enable insertion of the dielectric element 18 and then engages the locking recess 18B of the dielectric element 18, as shown in FIG. 19. The locking claw 16B has a substantially constant width at its base end, which is continuous with the ceiling wall 16T of the main body 16H. However, the locking claw 16B widens toward its leading end and can be brought into contact with the dielectric element 18, as shown in FIG. 18. The formation of the locking claw 16B forms a recess 16D of width L1 in the ceiling wall of the shielding shell 16.

Figure 9:
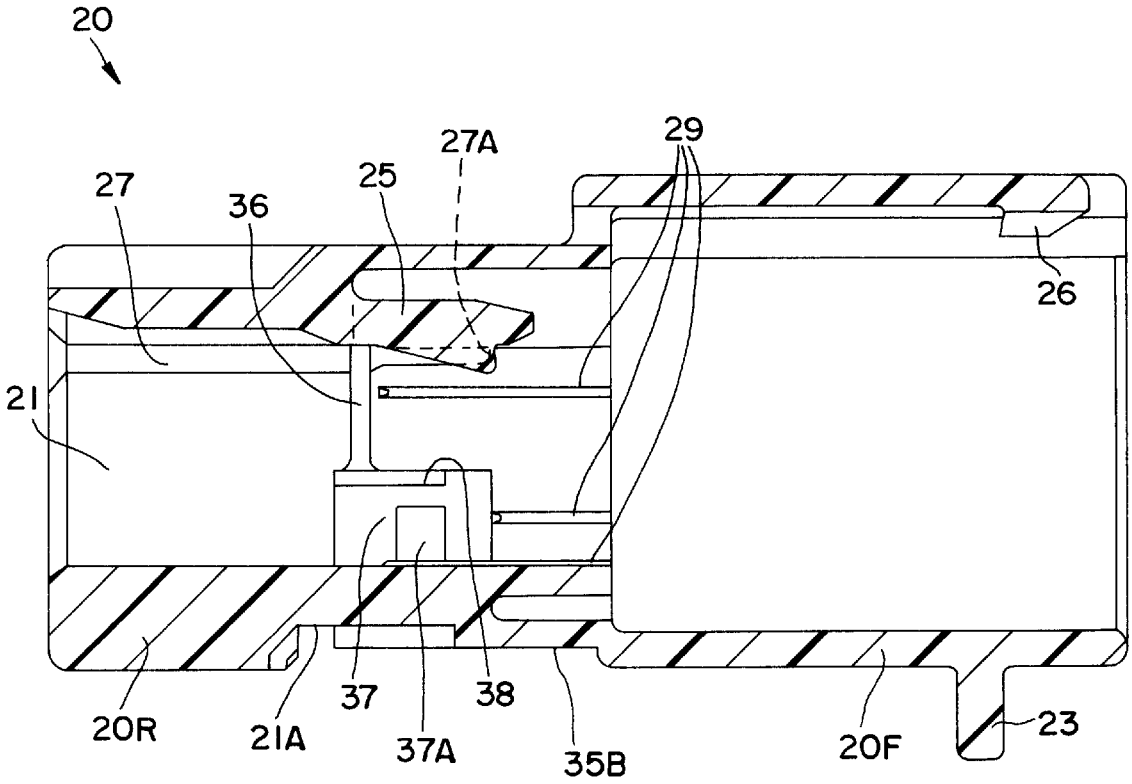
FIG. 9 is a side view in section of the housing.
Figure 10:
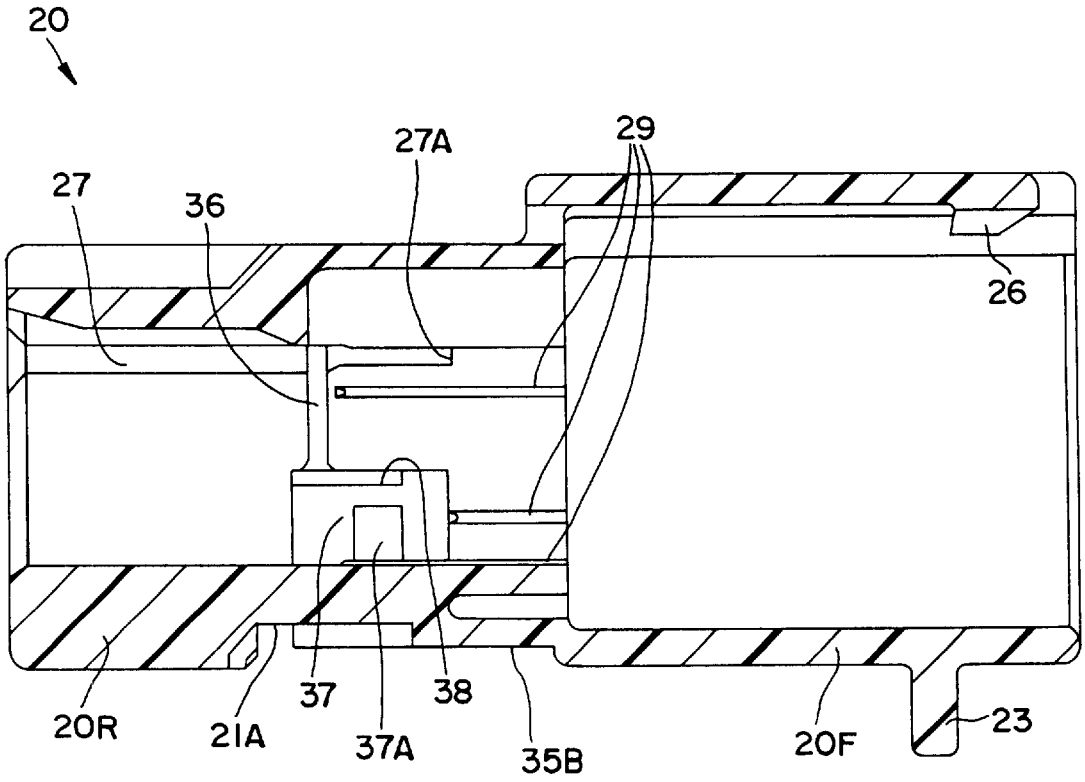
FIG. 10 is a side view in section of the housing at an other position.
Figure 11:
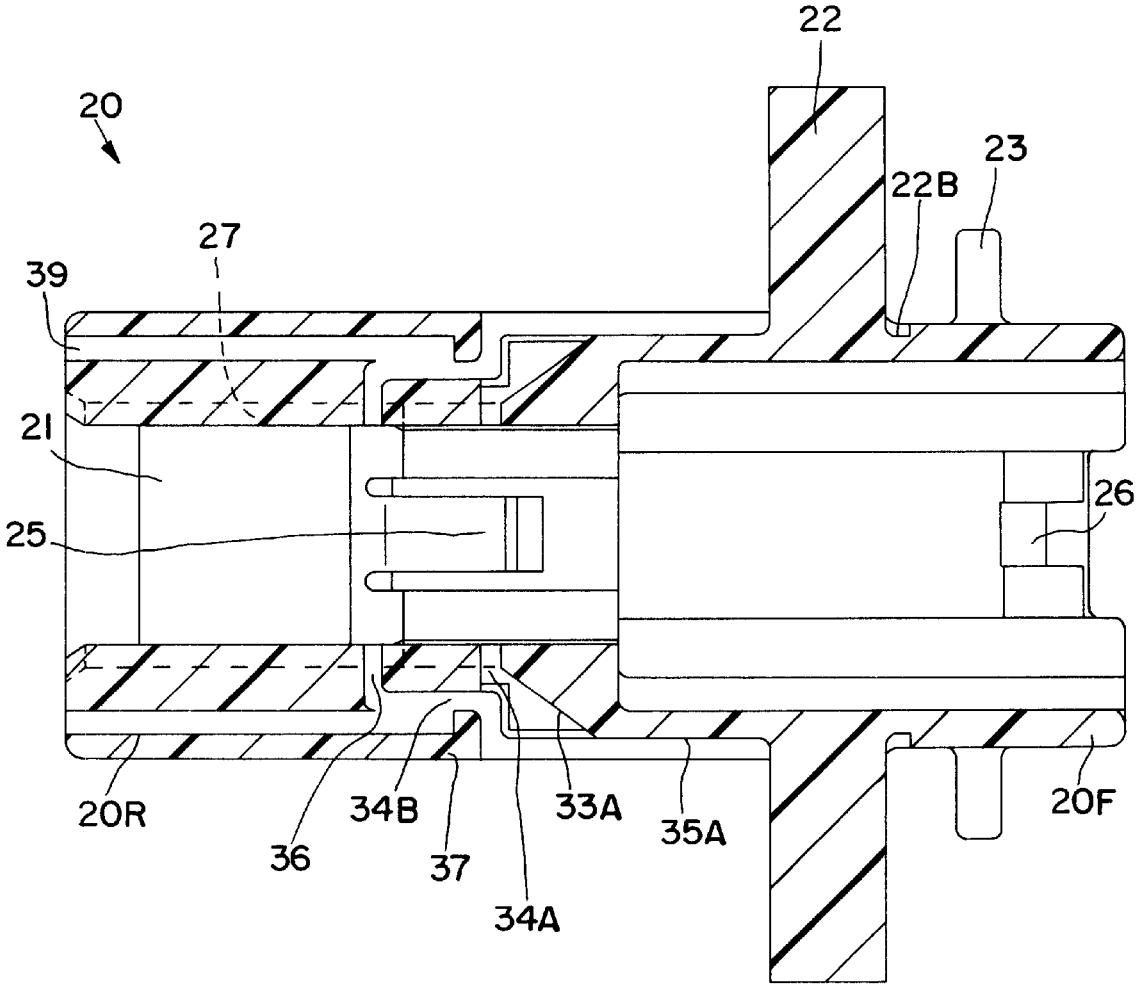
FIG. 11 is a plan view in section of the housing.

The connector 10 also includes a housing 20 that is integrally or unitarily formed of a synthetic resin. The housing 20 has a rectangular tubular receptacle 20F that opens forward, as shown in FIG. 9, for connection with a mating connector (not shown). Bulging portions 23 are formed near the front opening edge at each of the left and right outer side surfaces of the receptacle 20F and substantially in the middle of a bottom wall 51. The receptacle 20F of the housing 20 is insertable into the opening S of the shielded casing C by aligning the respective bulging portions 23 with the corresponding escaping portions T. The connector 10 then is held in the shielded casing C by displacing the housing 20 downward in Figures to engage the respective bulging portions 23 with the opening edges of the escaping portions T.

A housing lock 26 is formed on the ceiling surface for locked engagement with a mating connector inserted into the receptacle 20F. Furthermore, fixing pieces 22 bulge out from each of the left and right side walls of the receptacle 20F at positions spaced from the corresponding bulging portion 23 by a distance equal to or slightly greater than the thickness of the shielded casing C. Thus, the fixing pieces 22 can be brought into contact with the wall surfaces of the shielded casing C. The fixing pieces 22 are formed with fixing holes 22A that correspond to the mount holes A of the shielded casing C. Outwardly facing insertion grooves 22B are formed in the side walls of the receptacle 20F at locations forward of and adjacent to the fixing pieces 22.

A terminal holding portion 20R is provided in the housing 20 substantially continuously with the receptacle 20F, and a substantially rectangular cavity 21 penetrates the terminal holding portion 20R in forward and backward or longitudinal directions. An elastically or resiliently deformable lock 25 is cantilevered from the ceiling surface of the cavity 21, and can deflect up and down in Figures toward and away from the cavity 21. The lock 25 has a leading end 25B with a width L2 that exceeds the width L of the recess 16D, (L1<L2), as shown in FIG. 18.

Two guide grooves 27 are formed in the cavity 21, as shown in FIG. 9. The guide grooves 27 extend longitudinally from the rear end of the cavity 21 to a position substantially aligned with a locking portion of the lock 25. The rear ends of the guide grooves 27 define closed contact portions 27A. The guide grooves 27 are disposed and dimensioned to receive the stabilizers 19 of the shielding terminal 15. In this embodiment, the guide grooves 27 are narrower at the back than at the entrance. Thus, the shielding terminal 15 can be inserted with a small force since the stabilizers 19 can pass wide portions of the guide grooves 27 at an initial stage of insertion of the shielding terminal 15, and the shielding terminal 15 can be held so as not to shake since the width of the guide grooves 27 is narrower at a final stage of insertion.

Detection grooves 28 are formed at the opposite sides of the bottom surface of the cavity 21 and extend over the entire length.

Figure 7:
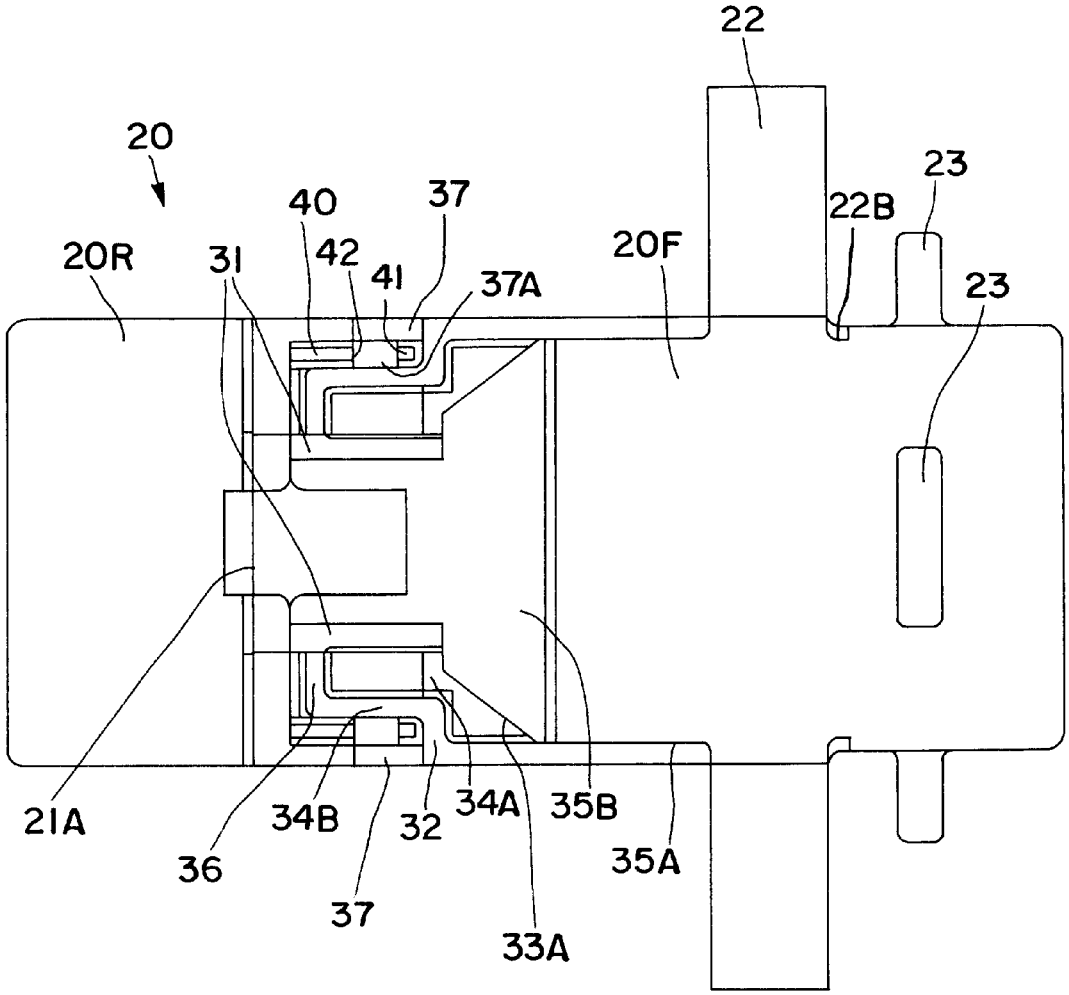
FIG. 7 is a bottom view of the housing.
Figure 8:
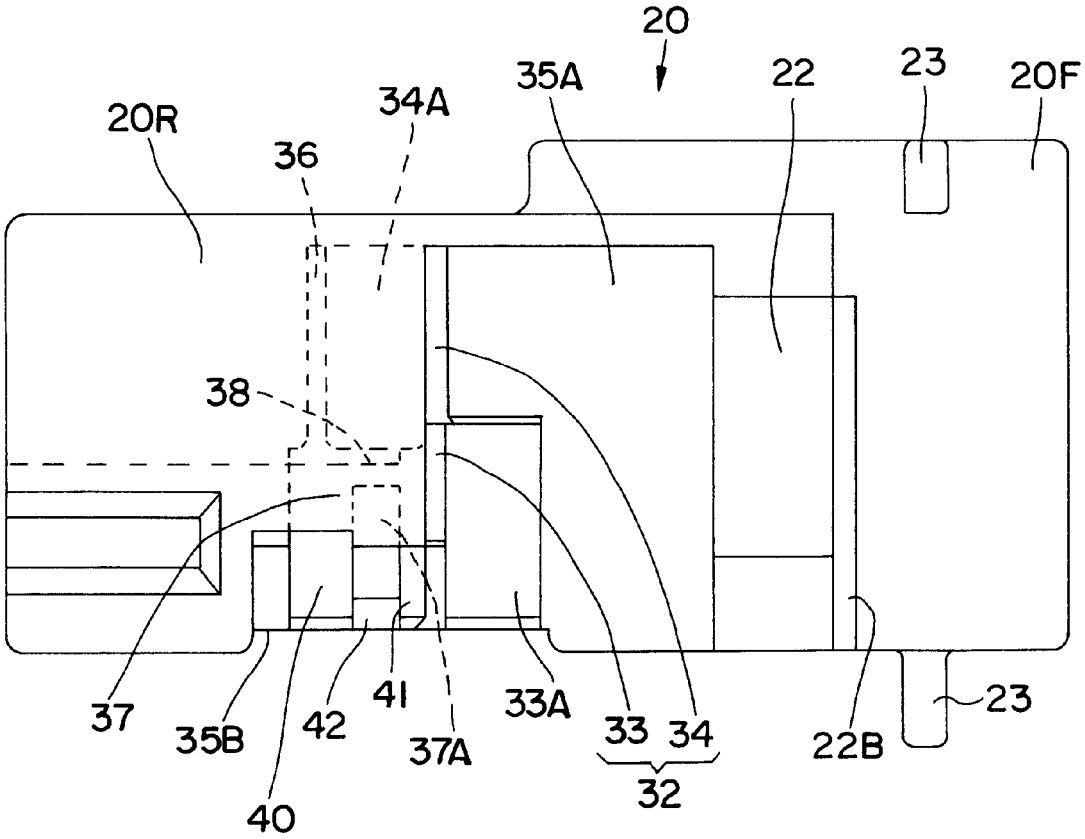
FIG. 8 is a side view of the housing.

Mount holes 31 are formed at the left and right sides of the bottom surface of the terminal holding portion 20R of the housing 20 and communicate with the cavity 21 inside the housing 20, as shown in FIG. 7. Substantially vertically extending insertion slots 32 are formed in opposite lateral walls of the terminal holding portion 20R and extend continuously from the mount holes 31. Recessed lateral stepped portions 35A and a recessed bottom stepped portion 35B are provided at areas of the bottom surface and the side surfaces of the terminal holding portion 20R adjacent the mount holes 31 and the insertion slits 32.

A lower half 33 of the opening edge of each slit 32 defines a slanted surface 33A that is sloped from the outer surface down toward the slit 32.

A hook-shaped extending wall 34A extends substantially parallel with a corresponding side wall 37 of the terminal holding portion 20R inside the housing 20 at one opening edge of an upper half 34 of the slit 32 of each lateral stepped portion 35A, as shown in FIG. 7. Thus, stepped grooves 34B are formed between the side walls 37 of the terminal holding portion 20R and the cavity 21. The rear ends of the stepped grooves 34B define hooking portions 36 that communicate with the guide grooves 27 at substantially right angles, as shown in FIG. 9.

Receiving pieces 40 are formed at the side walls 37 of the terminal holding portion 20R adjacent the opening edges of the mount holes 31. The outer surfaces of the two receiving pieces 40 are retracted inwardly from the surrounding surfaces. Suspended pieces 41 are formed before and substantially parallel to the receiving pieces 40, and clearances 42 are defined between the suspended pieces 41 and the receiving pieces 40.

Figure 12:
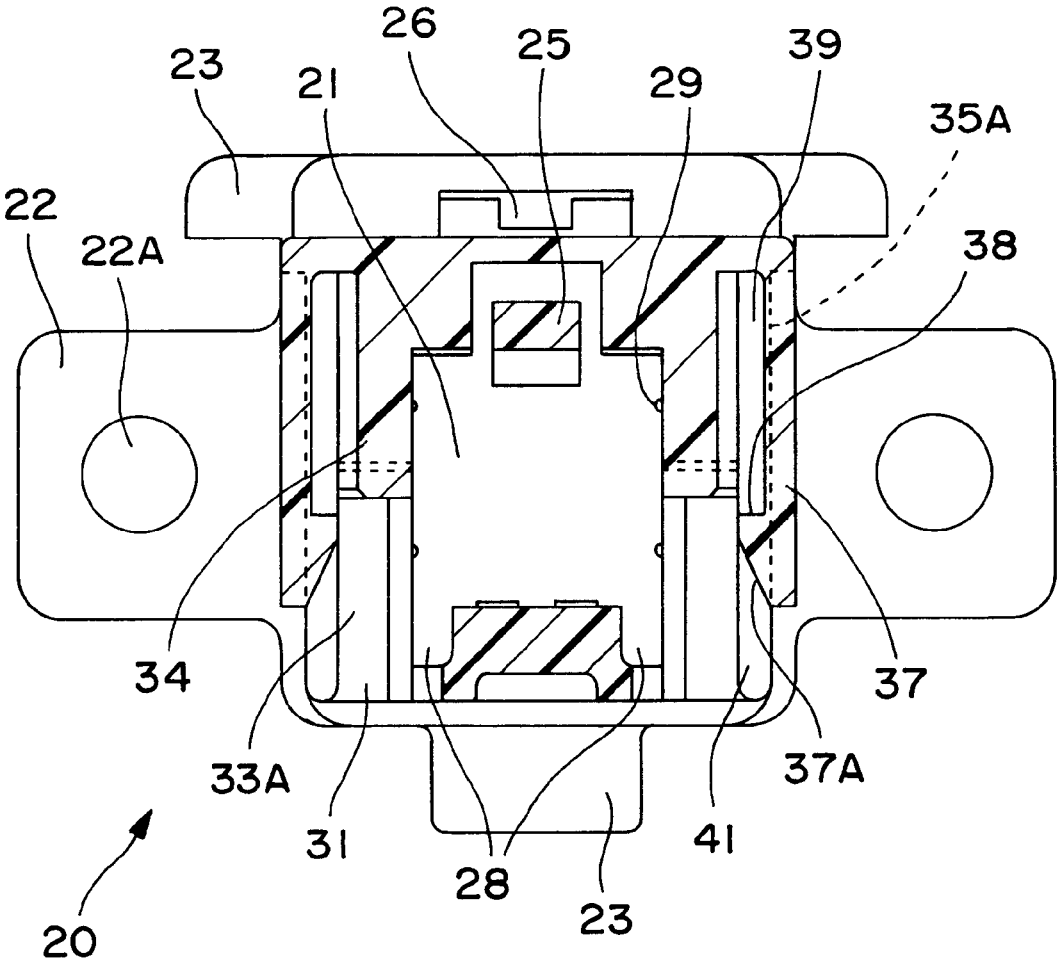
FIG. 12 is a section of the housing.

Slanted surfaces 37A are formed on parts of the inner surfaces of the side walls 37 of the terminal holding portion 20R continuous with the upper parts of the clearances 42 and stepped surfaces 38 are formed continuously with the slanted surfaces 37A, as shown in FIG. 12. The stepped surfaces 38 are formed using mold removing holes 39 formed in the rear end surface of the terminal holding portion 20R.

Figure 5:
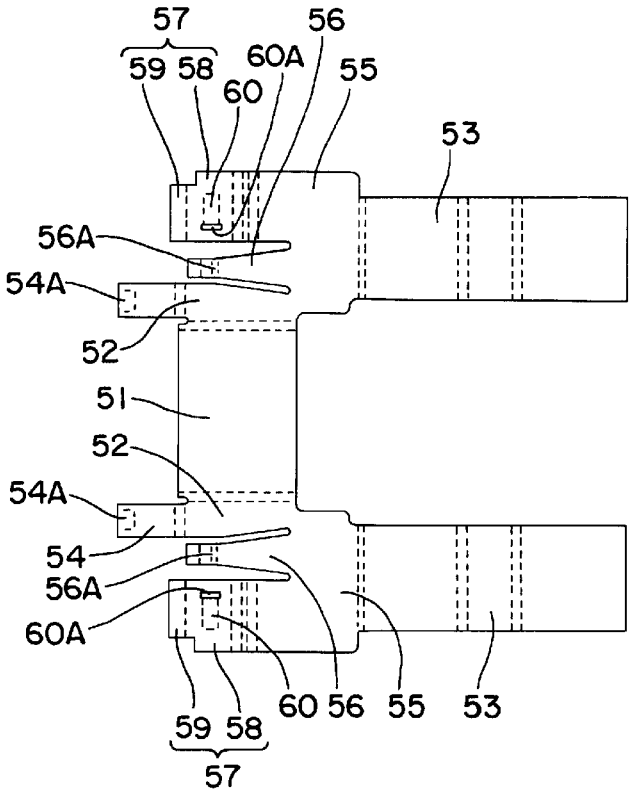
FIG. 5 is a development of the ground terminal.
Figure 6:
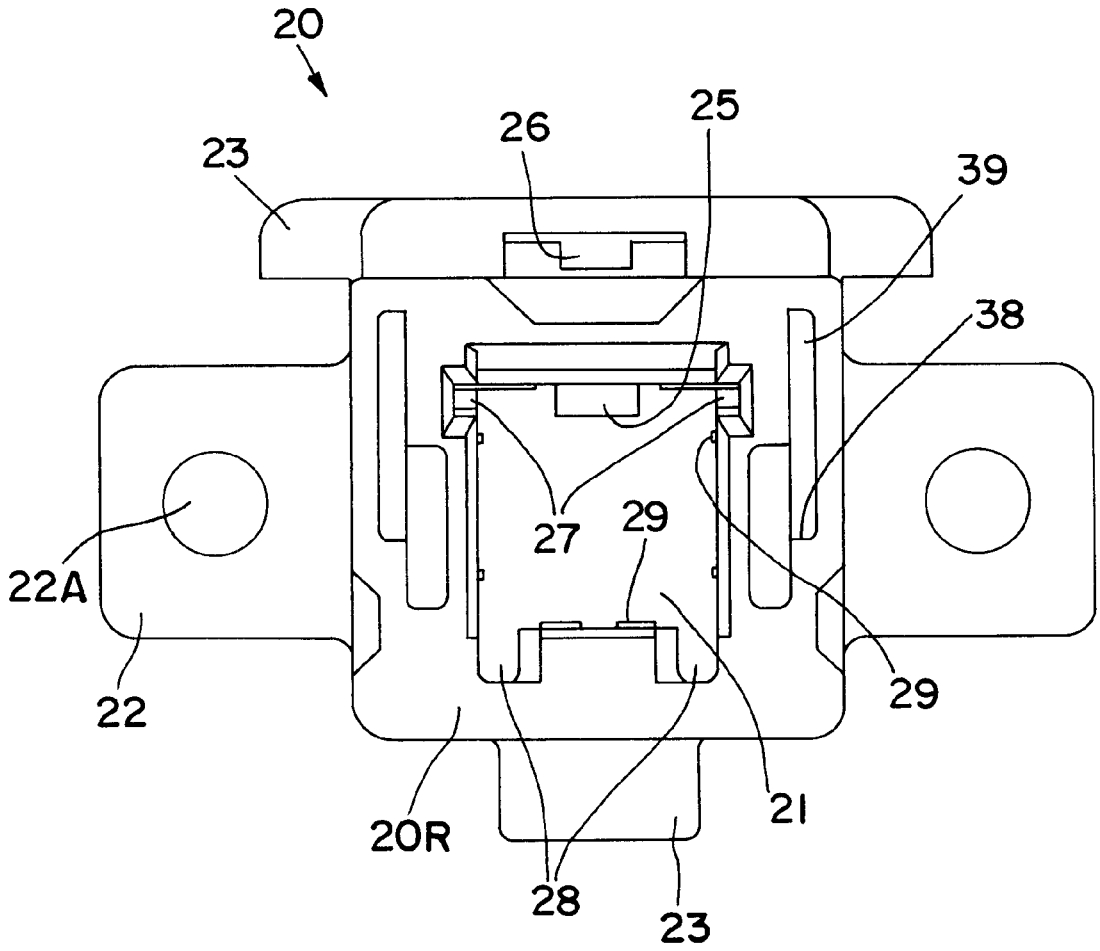
FIG. 6 is a rear view of a housing.
Figure 15:
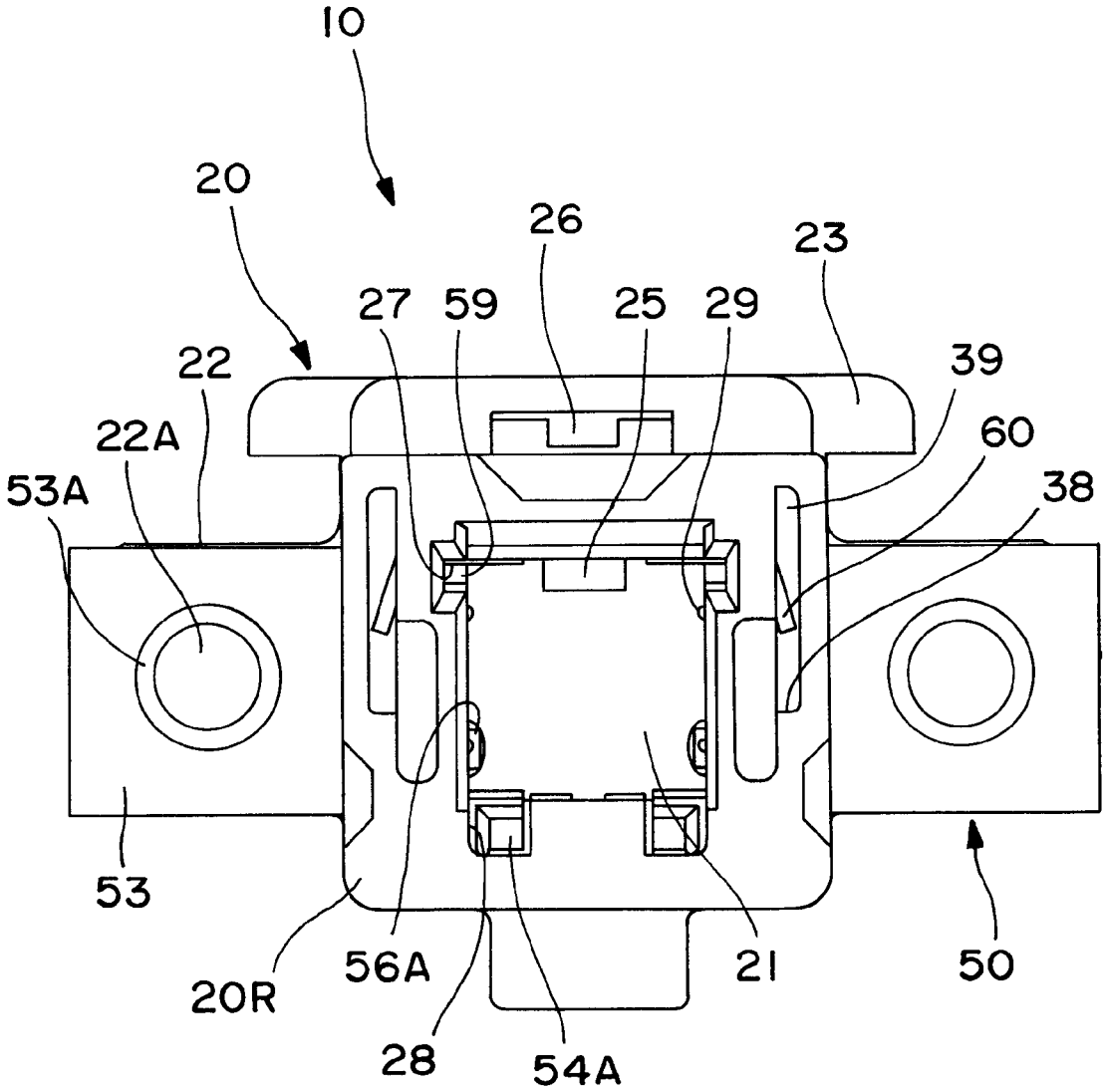
FIG. 15 is a rear view of the housing with the ground terminal mounted at the full locking position.

The connector 10 further includes a ground terminal 50 that can be mounted into the housing 20. The ground terminal 50 is made of an electrically conductive metallic plate, as shown in FIG. 5, and is formed by stamping, bending, folding and/or embossing the plate into the shape shown in FIG. 2. The ground terminal 50 has a bottom wall 51, and lateral walls 52 project from the bottom wall 51. The lateral walls 52 have rear ends bent inward along the rear end of the bottom wall 51 to form elastically or resiliently deformable full locking pieces 54. Full locking projections 54A project at ends of the full locking pieces 54 and are substantially opposed to each other. The full locking projections 54A can enter and engage the detection grooves 28 of the housing 20 when the ground terminal 50 is at a full locking position shown in FIG. 15.

Standing walls 55 are opposed to each other and extend from ends of the lateral walls 52 opposite the full locking pieces 54, as shown in FIG. 2. An inwardly open U-shaped surrounding piece 53 bulges out from each standing wall 55, and can be aligned and engaged with the fixing pieces 22. A through hole 53A is formed in each surrounding piece 53 and can be aligned with the corresponding fixing hole 22A when the surrounding pieces 53 are properly engaged with the fixing pieces 22, as shown in FIG. 4.

An engaging piece 57 is formed at an upper side of each standing wall 55 opposite from the surrounding piece 53. The engaging pieces 57 extend inwardly in steps and include opposing pieces 58 that are formed one step in from the standing walls 55. A locking claw 60 is formed substantially in the middle of each opposing piece 58 by making a cut and bending the cut portion outwardly. The locking claws 60 of this embodiment are formed by punching oblong holes 60A in the opposing pieces 58 and bending the punched portions, as shown in FIG. 5, so that the bottom ends of the locking claws 60 are straight. The locking claws 60 engage the housing 20 to hold the ground terminal 50 at its partial locking position.

Elastically or resiliently deformable touching pieces 59 are formed by bending the leading ends of the opposing pieces 58 inwardly at substantially right angles. The upper ends of the touching pieces 59 are cut off so that the touching pieces 59 are narrower than the opposing pieces 58.

Elastically or resiliently deformable contact pieces 56 are cantilevered from locations between the lateral end 52 and the engaging piece 57 of each standing wall 55, as shown in FIG. 2. The contact pieces 56 extend inwardly toward the cavity 21 so that the space between the contact pieces 56 gradually decreases. Additionally, the contact pieces 56 are narrowed gradually from their bases toward their leading ends. The leading ends of the contact pieces 56 are bent outwardly to form a substantially V-shape and define contact leading ends 56A, as shown in FIGS. 1 and 2.

The ground terminal 50 can be mounted in mount holes 31 at the left and right sides of the bottom surface of the terminal holding portion 20R of the housing 20, as shown in FIG. 7. The substantially vertically extending insertion slots 32 in opposite lateral walls of the terminal holding portion 20R extend continuously with the mount holes 31 and avoid an interference with the terminal holding portion 20R when the ground terminal 50 is mounted in the mount holes 31. Further, the lateral stepped portions 35A and the bottom stepped portion 35B are recessed by a depth substantially corresponding to the thickness of the metallic plate of the ground terminal 50, so that the outer surfaces of the ground terminal 50 are substantially flush with surrounding surfaces of the housing 20 when the ground terminal 50 is mounted.

The stepped grooves 34B conform with the shape of the engaging pieces 57 of the ground terminal 50 and the hooking portions 36 at the rear ends of the stepped grooves 34B are configured to accommodate the touching pieces 59.

The lower halves 33 of the slits 32 directly penetrate the cavity 21 through openings, so that the contact pieces 56 of the ground terminal 50 can be introduced into the cavity 21.

Additionally, each slanted surface 33A conforms to the inclination of the respective contact piece 56.

The receiving pieces 40 are held in close contact with the inner surfaces of the lateral ends 52 and the full locking pieces 54 of the ground terminal 50. Additionally, the outer surfaces of the two receiving pieces 40 are retracted inwardly from the surrounding surfaces by substantially the thickness of the ground terminal 50. The clearances 42 between the suspended pieces 41 and the receiving pieces 40 avoid an interference with the locking claws 60 formed on the opposing pieces 58 when the ground terminal 50 is mounted to the housing 20.

The locking claws 60 are displaced along the slanted surfaces 37A during mounting of the ground terminal 50, but are restored resiliently after reaching the stepped surfaces 38. Thus, the locking claws 60 engage the stepped surfaces 38, and the ground terminal 50 is held at its partial locking position.

Figure 13:
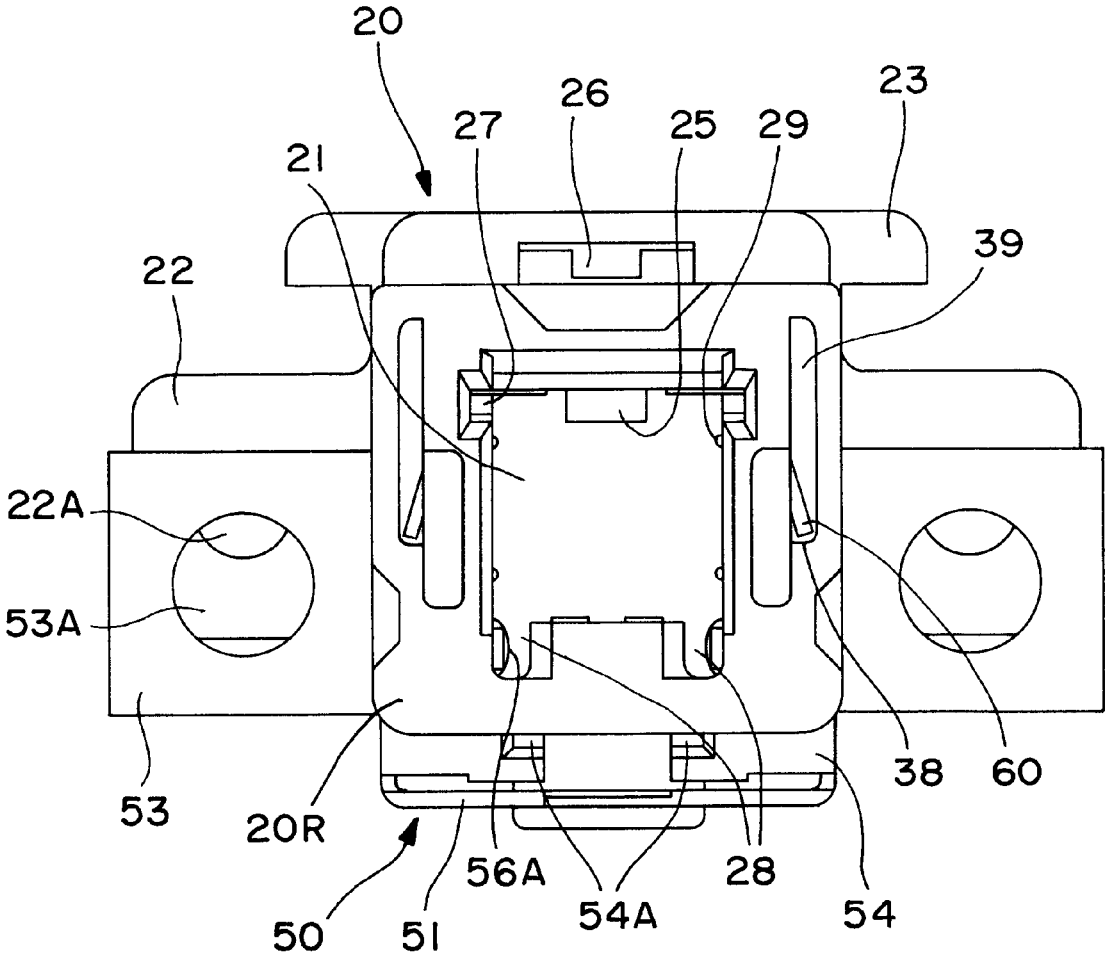
FIG. 13 is a rear view of the connector with the ground terminal mounted at the partial locking position.
Figure 14:
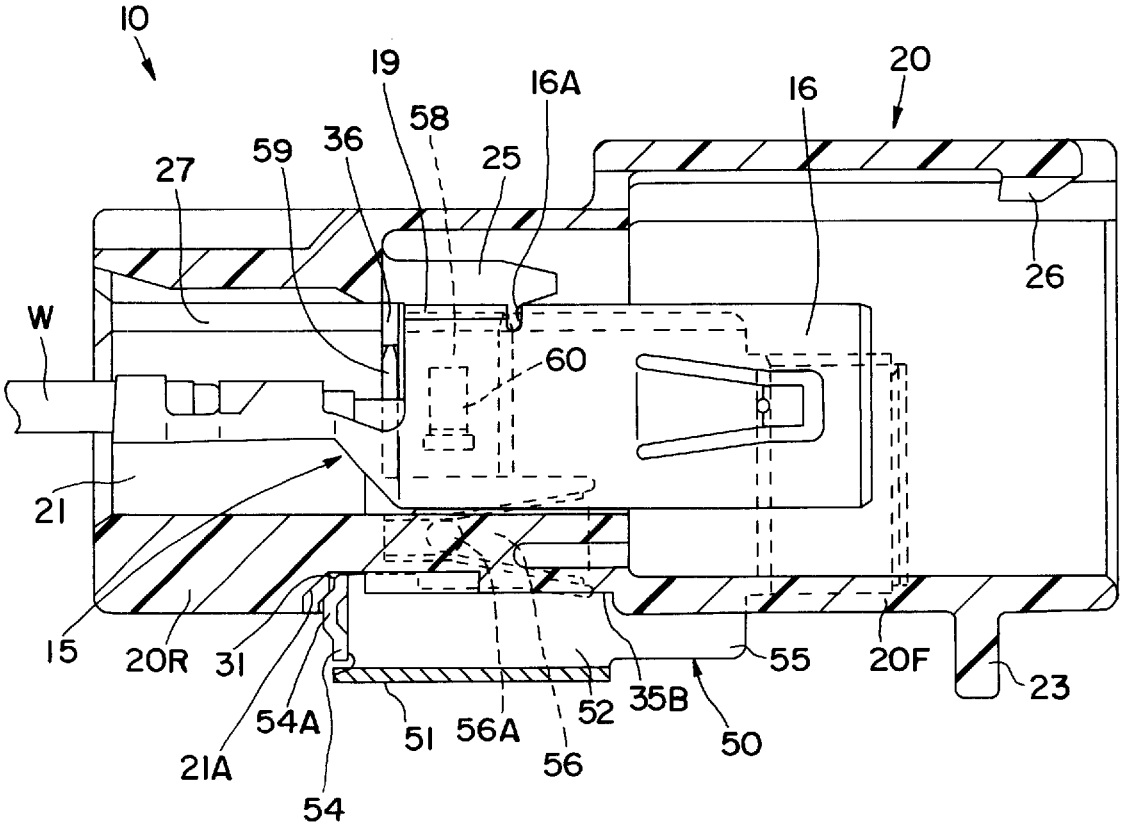
FIG. 14 is a side view in section of the connector when a shielding terminal is inserted with the ground terminal mounted at the partial locking position.

The connector 10 is assembled by first aligning the surrounding pieces 53 of the ground terminal 50 with the fixing pieces 22 of the housing 20. The leading ends of the surrounding pieces 53 then are inserted into the insertion grooves 22B. Simultaneously, the engaging pieces 57 are aligned substantially with the insertion slits 32, and the ground terminal 50 is pushed toward the housing 20 in this state. At this time, the locking claws 60 of the engaging pieces 57 pass through the clearances 42 between the suspended pieces 41 and the receiving pieces 40 and move while being elastically or resiliently deformed along the slanted surfaces 37A inside the housing 20. As the ground terminal 50 is pushed further, the contact pieces 56 enter inside the receiving pieces 40 and the suspended pieces 41. The locking claws 60 eventually reach the stepped surfaces 38 and are restored elastically or resiliently to engage the stepped surfaces 38, as shown in FIG. 13. The full locking projections 54A of the ground terminal 50 then engage with the edges of the mount holes 31 of the housing 20, as shown in FIG. 14. Thus, the ground terminal 50 cannot be pushed any further and is held at the partial locking position where it is prevented from disengagement from the housing 20.

At the partial locking position, the contact pieces 56 of the ground terminal 50 are located at their retracted positions in the detection grooves 28. However, the upper ends of the contact pieces 56 are lower than the bottom wall of the cavity 21, as shown in FIG. 13. The upper ends of the touching pieces 59 of the ground terminal 50 also are below the guide grooves 27 in the housing 20. Accordingly, the shielding terminal 15 can be inserted into the cavity 21 without interfering with the ground terminal 50 when the ground terminal 50 is at the partial locking position.

The lock 25 contacts the upper surface of the upper edge of the shielding shell 16 and moves onto the ceiling wall of the main body 16H when the shielding terminal 15 is inserted into the cavity 21. As a result, the lock 25 is deformed resiliently upward to permit the entrance of the shielding terminal 15. The lock arm 25 comprises a slanted portion 25A to guide, assist or allow an easier deflection of the lock arm 25 in response to contact with the shielding terminal 15. The shielding terminal 15 is inserted further to the back (or in a direction opposed to the fitting direction) while the ceiling wall of the main body 16H and the locking portion 25 are held in sliding contact with each other along the inserting direction ID. The leading end 25B of the locking portion 25 then passes the recess 16D of the shielding shell 16, as shown in FIG. 19.

The width L1 of the recess 16D of the shielding shell 16 of the shielding terminal 15 is narrower than the width L2 of the leading end of the lock 25 (see FIG. 18). Thus, the lock 25 passes the recess 16D without entering the recess 16D or getting caught by the recess 16D, as shown in FIG. 19.

The maximum width of the recess 16D corresponds to the widened leading end of the locking claw 16B, and may be equal to or slightly wider than the leading end 25B of the lock 25. However, the length of the leading end of the locking claw 16B is less than the length of the leading end portion of the lock 25. Therefore, the lock 25 does not enter this portion of the recess 16D.

Figure 21:
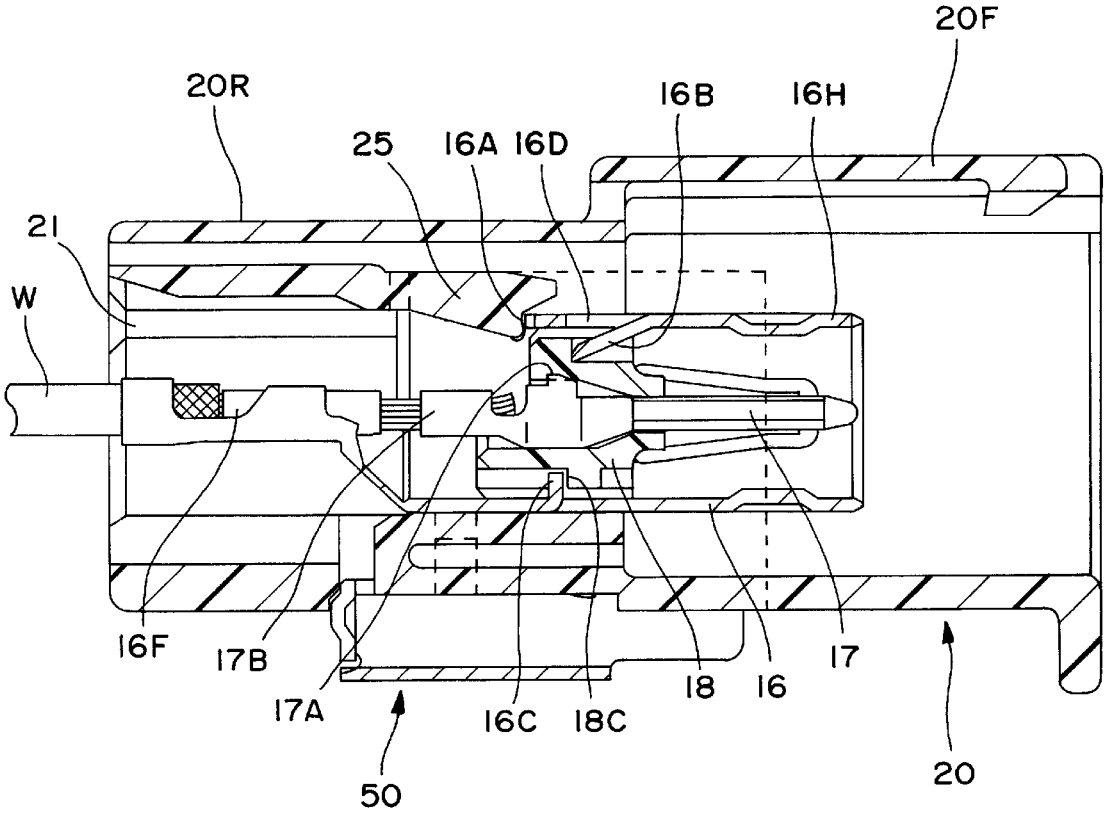
FIG. 21 is a side view in section of the housing after insertion of the shielding terminal.
Figure 22:
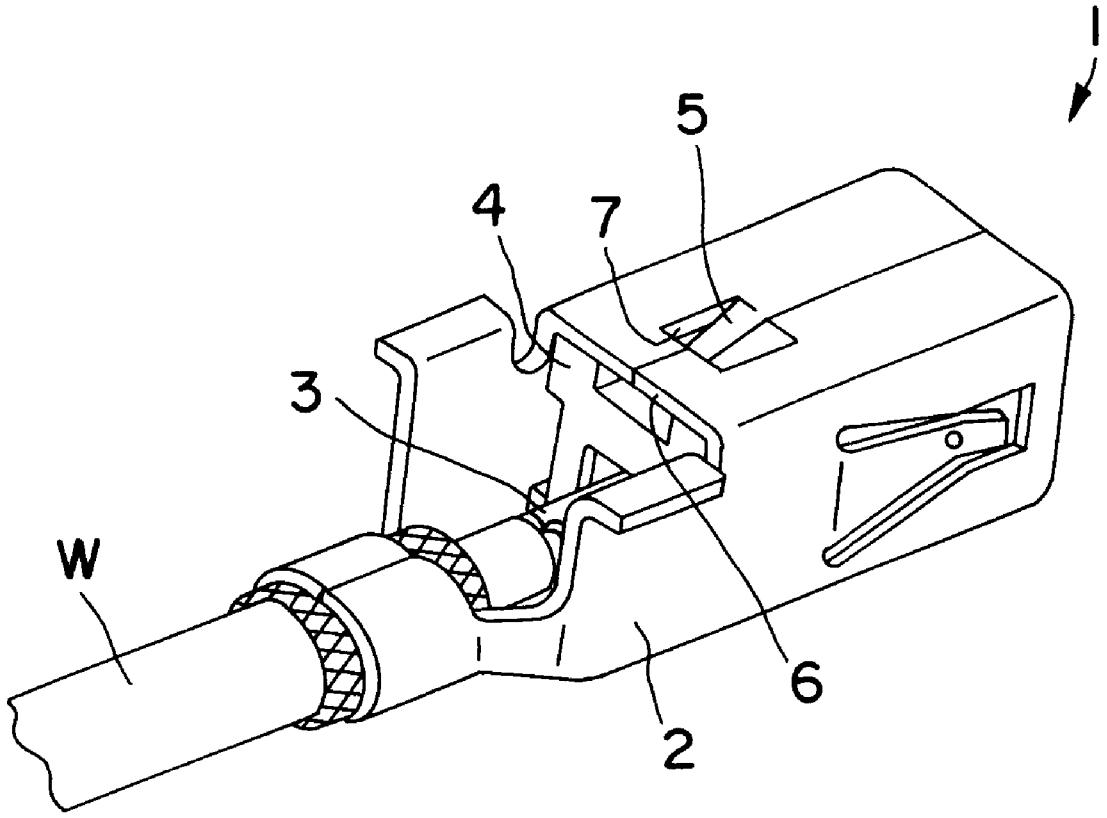
FIG. 22 PRIOR ART
FIG. 22 is a perspective view of a prior art shielding terminal.

The shielding terminal 15 is inserted to specified depth in the cavity 21, and the lock 25 is engaged with the locking edge 16A of the shielding shell 16, as shown in FIG. 21, to achieve partial locking. Elongated projections 29 on the left, right and bottom surfaces of the back of the cavity 21 prevent the inserted shielding terminal 15 from shaking.

The contact leading ends 56A of the contact pieces 56 are located in the detection grooves 28 when the ground terminal 50 is at the partial locking position. Thus, the connector 10 then can be placed on a photoelectric detector and light or laser beams can be projected in the longitudinal direction of the detection grooves 28 to determine whether the ground terminal 50 is properly at the partial locking position. This determination is made based on whether the laser beams are detected at light receiving ends. Therefore, a mounting error of the ground terminal 50 can be detected automatically based on the detection result. The presence of the contact leading ends 56A of the contact pieces 56 in the detection grooves 28 also can be detected visually.

Figure 16:
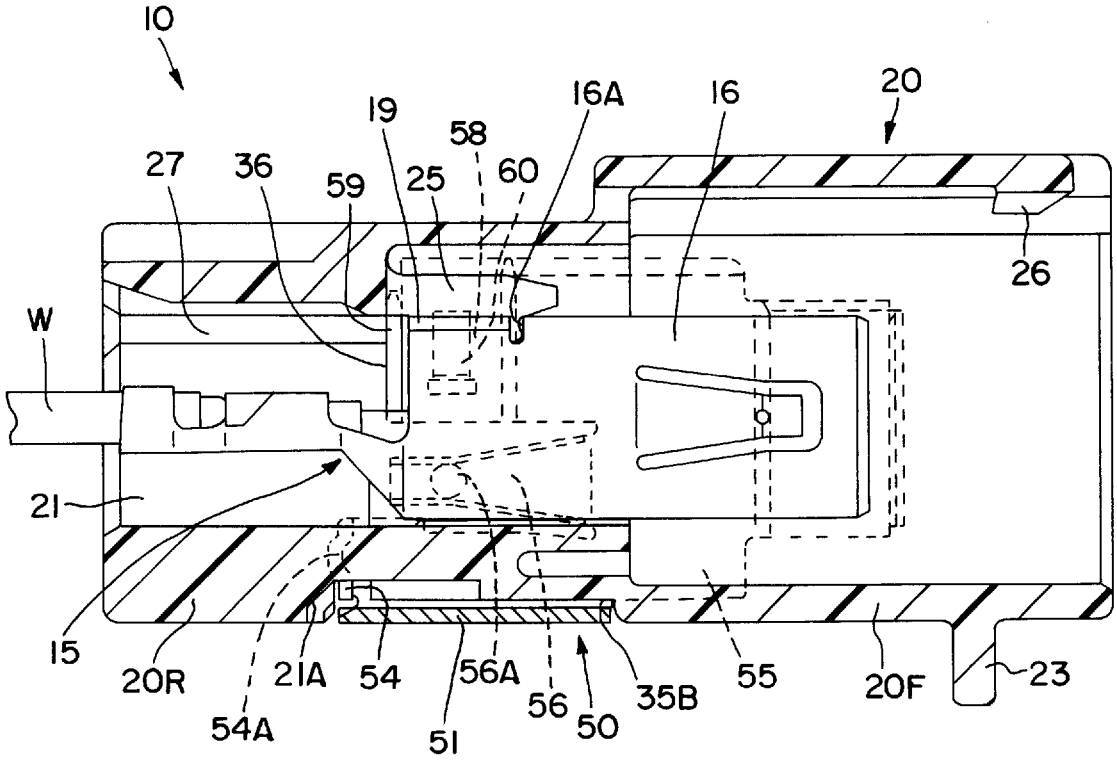
FIG. 16 is a side view in section of the connector in which a shielding terminal is doubly locked.

The ground terminal 50 can be pushed further from the partial locking position. As a result, the full locking pieces 54 deform inward and the full locking projections 54A enter the mount holes 31. The full locking pieces 54 then align with the detection grooves 28 and are restored elastically or resiliently. Thus, the full locking projections 54A engage the inner walls of the detection grooves 28, and the entire ground terminal 50 is at the full locking position, as shown in FIG. 16.

The touching pieces 59 enter the guide grooves 27 behind the stabilizers 19 of the shielding terminal 15 when the ground terminal 50 is at the full locking position to prevent the shielding terminal 15 from coming out of the cavity 21. Thus, both the lock 25 and the ground terminal 50 lock the shielding terminal 15 in the cavity.

The ground terminal 50 that has reached the full locking position has the contact leading ends 56A of the contact pieces 56 in contact with the left and right side surfaces of the shielding shell 16 of the shielding terminal 15. In this way, the ground terminal 50 and the shielding terminal 15 are connected electrically. The contact pieces 56 contact with the shielding shell 16 from left and right sides with resilient or elastic forces. Thus, a contact resistance between the ground terminal 50 and the shielding terminal 15 is reduced and the shielding terminal 15 is prevented from shaking in the transverse direction. Further, the upper ends of the full locking pieces 54 contact and push up the bottom surface of the shielding terminal 15. Accordingly, the shielding terminal 15 also is prevented from shaking in vertical direction.

The shielding terminal 15 might not be inserted to proper depth. In this situation, the stabilizers 19 block the hooks 36 of the stepped grooves 34B, which are passages for the touching pieces 59. Thus, the touching pieces 59 cannot enter the guide grooves 27, and an operator can notice the insufficient insertion of the shielding terminal 15 by such an abnormality.

The through holes 53A of the surrounding pieces 53 and the fixing holes 22A of the fixing pieces 22 are aligned when the ground terminal 50 reaches the full locking position on the housing 20. Thus, the entire connector 10 can be mounted into the mount hole A in the wall surface of the shielded casing C by passing screws B through the aligned holes 53A and 22A. However, the through holes 53A and the fixing holes 22A are not aligned before the ground terminal 50 reaches the full locking position. Therefore, the screws B cannot be inserted through the mount holes A, the through holes 53A and the fixing holes 22A if the ground terminal 50 is not at the full locking position. Accordingly, a mounting error of the ground terminal 50 can be detected at when the connector 10 is mounted in the shielded casing C. Of course, the error also can be detected visually and/or automatically before mounting of the connector 10.

The shielding terminal 15 may be withdrawn from the housing 20 for maintenance by inserting a jig into a disengaging recess 21A at the bottom of the housing 20 and pushing the bottom wall 51 of the ground terminal 50 down to the outside. Thus, the ground terminal 50 is returned to the partial locking position to cancel locking by the ground terminal 50. A jig also may be inserted from the front side of the connector 10 to cancel locking by the lock 25. In this way, the contact pieces 56 are brought back to the retracted positions. Thus, a resistance during withdrawal of the ground terminal 15 is small.

As described above, the recess 16D in the upper surface of the shielding shelf 16 of the shielding terminal 15 is narrower than the lock 25 and, accordingly, the lock 25 neither enters nor gets caught by the recess 16D when the shielding terminal 15 is inserted into the cavity 21. Therefore, the shielding terminal 15 can be inserted smoothly.

The leading end portion of the locking claw 16B that contacts the locking recess 18B of the dielectric element 18 is wide, and hence a force for locking the dielectric element 18 can be strengthened. The width of the portion of the recess 16D corresponding to the leading edge of the locking claw 16B can be at least as wide as the leading end 25B of the lock 25. However, this wide part of the recess 16D is shorter than the lock 25 in the insertion direction ID. Accordingly, the lock 25 neither enters nor gets caught by the recess 16D.

As described above, the contact pieces 56 of the ground terminal 50 are movable between the retracted position and the contact portion and can be locked at the respective positions, and the shielding terminal 15 can be inserted into the housing 20 at the retracted position where the contact pieces 56 and the shielding terminal 15 do not interfere with each other. Thus, an insertion resistance of the shielding terminal can be reduced. Further, the movements of the contact pieces 56 from the retracted positions to the contact positions are linked with the movement of the ground terminal 50 from the partial locking position to the full locking position. Thus, the number of operation steps performed for assembling the connector can be reduced, and an assembling operability of the connector 10 can be improved.

The connector 10 can doubly lock the shielding terminal 15 by partial locking by the lock 25 of the cavity 21 and full locking by the touching pieces 59 of the ground terminal 50. Further, since the ground terminal 50 is mounted in a direction intersecting with the insertion direction of the shielding terminal 50, the shielding terminal 15 can be locked securely so as not to come out.

The shielding terminal 15 the ground terminal 50 is assembled to the housing 20 at the partial locking position. Accordingly, it is not necessary to hold the housing 20 and the ground terminal 50 separately.

Further, the contact pieces 56 are between the bottom wall 51 and the engaging pieces 57 in the ground terminal 50, and hence are protected from deformation due to contact by another member.

The location of the contact leading ends 56A of the contact pieces 56 of the ground terminal 50 at the partial locking position can be detected by causing the beams for photoelectric detection to pass along the detection grooves 28. Thus, defective products that have the contact pieces 56 displaced from their proper positions can be left out before shipment.

The present invention is not limited to the above described and illustrated embodiment. For example, following embodiments are also embraced by the technical scope of the present invention as defined in the claims. Beside the following embodiments, various changes can be made without departing from the scope and spirit of the present invention as defined in the claims.

The recess 16D is formed by the formation of the locking claw 16B for locking the dielectric element 18 in the foregoing embodiment. However, the recess may be formed by the formation of a part other than the locking claw 16B.

The shape of the recess 16D is not limited to the one of the foregoing embodiment. According to the present invention, the recess 16D can take any shape provided that the width thereof is narrower than that of the locking portion.

What is claimed is:

1. A shielding terminal for use with a housing, said housing having at least one resiliently deformable lock with a leading end for locking the shielding terminal in the cavity, the leading end having a width, said shielding terminal comprising:

an inner terminal configured for connection with a core of a shielded wire;

a dielectric element surrounding at least a portion of the inner terminal;

a shielding shell with a main body at least partly surrounding the inner terminal the dielectric element, the shielding shell being configured for insertion in the cavity and having at least one side surface disposed for contact with the leading end of the lock, a recess being formed in the side surface of the main body, the recess having a width less than the width of the leading end of the lock, the main body having an engaging portion at a position behind the recess for engaging the lock and locking the shielding terminal within the cavity when the shielding terminal is inserted to a proper depth, at least one locking claw being formed in one side surface of the main body by making a cut in the side surface and bending a cut portion inwardly, the locking claw having a base end continuous with the main body and a leading end cantilevered from the main body, the leading end being wider than the base end and being configured for locking the inner terminal in the shielding shell.

2. The shielding terminal of claim 1, wherein the main body is in the form of a substantially rectangular tube.

3. The shielding terminal of claim 1, wherein the side surface is formed such that the lock is resiliently deformed while being held in sliding contact with the side surface along an inserting direction at an intermediate stage of insertion of the shielding terminal into the cavity.

4. The shielding terminal of claim 1, wherein the width of the recess is at least equal to a width of the locking claw toward its leading end.

5. A shielded connector comprising:

a connector housing having at least one cavity and a resiliently deformable lock, the lock having a leading end cantilevered into the cavity, the leading end defining a width; and at least one shielding terminal secured in the cavity by the lock, the shielding terminal comprising an inner terminal configured for connection with a core of a shielded wire, a dielectric element surrounding at least a portion of the inner terminal, and a shielding shell with a main body at least partly surrounding the inner terminal and the dielectric element, the shielding shell having at least one side surface disposed for contact with the leading end of the lock, a recess being formed in the side surface of the main body, the recess having a width less than the width of the leading end of the lock, the main body having an engaging portion at a position behind the recess for engaging the lock and locking the shielding terminal within the cavity when the shielding terminal is inserted to a proper depth, at least one locking claw being formed in one side surface of the main body by making a cut in the side surface and bending a cut portion inwardly, the locking claw having a base end continuous with the main body and a leading end cantilevered from the main body, the leading end being wider than the base end and being configured for locking the inner terminal in the shielding shell.

6. The connector of claim 5, wherein the lock (25) is resiliently deformed while being held in sliding contact with the side surface (16T) of the shielding shell (16) where the recess (16D) is formed along an inserting direction (ID) at an intermediate stage (FIG. 19) of insertion of the shielding terminal (15) into the cavity (21).

* * * * *